US005972863A

United States Patent [19]

Heo et al.

[11] Patent Number: 5,972,863

[45] Date of Patent: Oct. 26, 1999

[54] SLURRY COMPOSITIONS FOR POLISHING WAFERS USED IN INTEGRATED CIRCUIT DEVICES AND CLEANING COMPOSITIONS FOR REMOVING ELECTRON WAX AFTER POLISHING

[75] Inventors: Tae-yeol Heo, Kyungki-do; Jung-min Park; Sung-hoon Cho, both of Seoul; Gi-jung Kim, Kyungki-do, all of Rep. of Korea

[73] Assignee: Samsung Electronics Co., Ltd., Rep. of Korea

[21] Appl. No.: 09/041,274

[22] Filed: Mar. 12, 1998

[30] Foreign Application Priority Data

Mar. 15, 1997 [KR] Rep. of Korea ..... 97-8893

[51] Int. Cl.[6] ..... C11D 3/14; C11D 7/06; C11D 9/20

[52] U.S. Cl. ..... 510/175; 510/181; 510/186; 510/202; 510/236; 510/241; 510/242; 510/245; 510/252; 510/254; 510/268; 510/272; 510/460; 134/1.2

[58] Field of Search ..... 510/175, 181, 510/186, 202, 236, 241, 242, 245, 252, 254, 268, 272, 460; 134/1.2, 1.3

[56] References Cited

U.S. PATENT DOCUMENTS

| | | | |
|---|---|---|---|
| 4,057,939 | 11/1977 | Basi | 51/281 R |
| 4,284,533 | 8/1981 | Imamura et al. | 252/542 |
| 4,491,478 | 1/1985 | Williamson | 106/3 |
| 4,710,232 | 12/1987 | Tahbaz | 134/1 |
| 4,840,746 | 6/1989 | Shiozaki et al. | 252/174.25 |
| 4,954,459 | 9/1990 | Avanzino et al. | 437/228 |
| 5,032,203 | 7/1991 | Doy et al. | 156/345 |
| 5,670,011 | 9/1997 | Togawa et al. | 156/345 |

*Primary Examiner*—Mark Kopec
*Assistant Examiner*—Charles Boyer
*Attorney, Agent, or Firm*—Myers Bigel Sibley & Sajovec

[57] ABSTRACT

Compositions useful for polishing wafers to be used in microelectronic devices comprise silicon dioxide, aluminum oxide, sodium hydroxide, and water. Cleaning compositions for removing electron wax from wafers to be used in microelectronic devices comprise from about 2 to about 6 percent by weight of ammonium hydroxide, from about 10 to about 22 percent by weight of hydrogen peroxide, and water.

4 Claims, 4 Drawing Sheets

SLURRY COMPOSITIONS FOR POLISHING WAFERS USED IN INTEGRATED CIRCUIT DEVICES AND CLEANING COMPOSITIONS FOR REMOVING ELECTRON WAX AFTER POLISHING

FIELD OF THE INVENTION

The invention generally relates to compositions for cleaning and polishing wafers to be used in microelectronic devices.

BACKGROUND OF THE INVENTION

A variety of equipment may be employed in manufacturing microelectronic (e.g., semiconductor) devices. For example, chemical mechanical polishing (CMP) apparatuses are typically used to detect the concentrations of wafer dopants at various stages of processing. CMP apparatuses may also be used to chemically or mechanically planarize the wafer surfaces in an attempt to improve step coverage. In addition, angle polishing apparatuses can be used to chemically or physically cut-process materials. More specifically, these apparatuses typically use bevels to grind the corner sides of the materials.

An example of a conventional angle polishing apparatus is proposed by Mimasu Co. of Japan. In general, this apparatus is typically known as a pre-processing apparatus in that it typically processes wafers prior to the wafers being manufactured into microelectronic devices.

A more precise analysis of processes involved in device manufacturing is generally desirable. Thus, it may be desirable to have a more integrated system in that sample cutting, pre-grinding, angle polishing, wax removal, and wafer surface analysis may be conducted in a coordinated fashion. FIG. 1 is a flow chart illustrating conventional sample processing. First, a predetermined sample size is cut from the wafer. This operation is typically referred to as the cutting step. The cut sample is usually next attached on the angle stage of an angle polishing apparatus by employing conventional electron wax-like resins. This procedure is typically referred to as the attaching step. Electron wax which may be present on the edge of the attached sample is subsequently cleaned (i.e., cleaning step), and the sample surface is then roughly grounded in an attempt to shorten the polishing time (i.e., a pre-grinding step). With respect to the pre-grinding step, the sample is usually attached on the surface of a glass plate, and the thickness of the sample decreases by approximately 2 mm. An example of a commercially employed glass plate is Model No. FO-1200 sold by JAPAN Fujimi Co.

During the grounding operation, the corner of the sample is typically ground while the angle polishing slurry is fed to the surface plate of the apparatus (i.e., an angle polishing step). The sample is next detached from the angle polishing operation, and electron wax which may be present on the sample surface is removed (i.e., wax removal step). Optionally, an etching step such as, for example, a SECCO etching, is carried out prior to performing predetermined analysis steps.

It should be noted that in order to carry out an accurate contaminant (e.g., oxygen precipitate) concentration analysis, it is preferred that the surface of the sample be scratch-free after angle polishing. A conventional slurry typically used for angle polishing comprises between 20 and 21 weight percent of silicon dioxide ($SiO_2$), between 0.1 and 0.2 weight percent of aluminum oxide, and deionized water. The silicon dioxide particle sizes often range from 10 nm to 20 nm in diameter. An apparatus which may be used to supply polishing slurry is illustrated by FIG. 2. More particularly, the slurry composition is induced from slurry supply tank 1 and is supplied to a surface plate via slurry supply hose 3.

Notwithstanding any possible advantages, potential problems may result when employing silicon dioxide particles having the above sizes. Specifically, when the concentration of silicon dioxide in the slurry is high, the slurry often solidifies in the slurry supply tank 1. When the concentration of silicon dioxide in the slurry is low, there is a heightened possibility that surface scratching may occur during angle polishing. In general, the use of the above silicon dioxide slurries may be disadvantageous in that lengthy times are often needed to polish wafer surfaces such as, for example, 5 hours or greater.

Electron wax removal from a sample is usually carried out by mounting the sample on a gauze or cotton cloth, and then applying an acetone-containing swab to the sample. This procedure, however, is potentially disadvantageous in that the cleaning of the electron wax is often time-consuming. Moreover, the cleaning may involve excessively exposing the sample to the atmosphere. As a result, the sample may become contaminated which often distorts sample analysis.

There is a need in the art for compositions useful for angle polishing wafers to be used in microelectronic devices which reduce the occurrence of wafer scratching. Additionally, there is a need in the art for cleaning compositions which remove electron wax from wafers more efficiently than conventional cleaning compositions in terms of shortened time and reduced contaminant formation subsequent to cleaning.

SUMMARY OF THE INVENTION

In a first aspect, the invention provides compositions useful for polishing wafers used in microelectronic devices. The compositions comprise silicon dioxide, aluminum oxide, sodium hydroxide, and water.

In a second aspect, the invention provides methods of angle polishing wafers to be used in microelectronic devices. The methods comprise applying compositions to the wafer surfaces to angle polish the wafers. The compositions comprise silicon oxide, aluminum oxide, sodium hydroxide, and water.

In a third aspect, the invention provides cleaning compositions for removing electron wax from wafers to be used in microelectronic devices. The compositions comprise from about 2 to about 6 percent by weight of ammonium hydroxide, from about 10 to about 22 percent by weight of hydrogen peroxide, and water.

In a fourth aspect, the invention provides methods of removing electron wax which is present on a wafer to be used in a microelectronic device. The methods comprise contacting the wafers with cleaning compositions comprising from about 2 to about 6 percent by weight of ammonium hydroxide, from about 10 to about 22 percent by weight of hydrogen peroxide, and water, and contacting the wafers with water. The contacting steps are carried out at temperatures from about 70° C. to about 110° C. for about 1 minute to about 20 minutes.

The invention is potentially advantageous. The compositions useful for angle polishing are desirable in that reduced scratching of the wafer surfaces may be experienced. Additionally, the electron wax cleaning compositions are useful in that they are capable of removing the electron wax without employing a mechanical cleaning step.

DETAILED DESCRIPTION OF THE PREFERRED EMBODIMENTS

The present invention now will be described more fully hereinafter with reference to the accompanying drawings and examples, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

In a first aspect, the invention relates to compositions useful for polishing wafers used in microelectronic (e.g., semiconductor) devices. The compositions comprise silicon dioxide, aluminum oxide, sodium hydroxide, and water.

The compositions may contain various amounts of the above components. For example, the compositions may comprise from about 100 ml to about 200 ml of aqueous solutions of sodium hydroxide. The aqueous solutions may comprise from about 1 to about 10 percent by weight of sodium hydroxide. Additionally, the compositions may comprise from about 1000 ml to about 7000 ml of water, preferably deionized water. Moreover, the compositions may comprise about 700 ml of slurries which comprises from about 20 to about 21 percent by weight of silicon dioxide and from about 0.1 to about 0.2 percent by weight of aluminum oxide. Deionized water may be used in the above compositions.

In a second aspect, the invention relates to methods of angle polishing wafers to be used in microelectronic devices. The methods comprise applying the compositions described above to wafer surfaces for a predetermined period of time.

In a third aspect, the invention relates to cleaning compositions for removing electron wax from wafers to be used in microelectronic devices. The cleaning compositions comprise from about 2 to about 6 percent by weight of ammonium hydroxide, from about 10 to about 22 percent by weight of hydrogen peroxide, and water. Preferably, the cleaning compositions comprise from about 3 to about 5 percent by weight of ammonium hydroxide and from about 14 to about 18 percent by weight of hydrogen peroxide. Deionized water may be used in the cleaning compositions.

In a fourth aspect, the invention relates to methods for removing electron wax which is present on wafers. The methods comprise contacting the wafers with the cleaning solutions, and then contacting the wafers with water. The contacting step is carried out at temperatures ranging from about 1 min to about 110° C. for about 1 min to about 20 min. This is preferably carried out by heating the cleaning solutions to this temperature range for the above time period.

Figure 1:
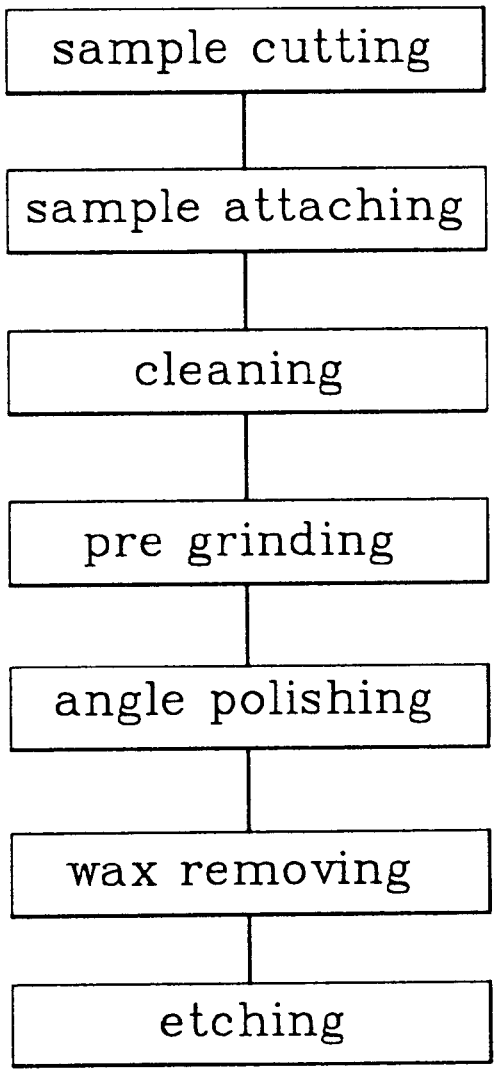
FIG. 1 (PRIOR ART)
FIG. 1 is a flow chart illustrating steps used in the conventional processing of a wafer sample.
Figure 2:
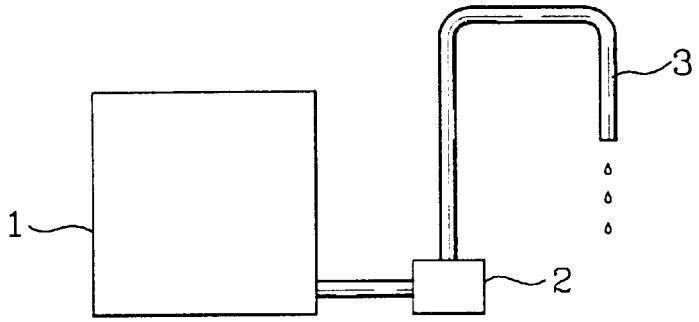
FIG. 2 (PRIOR ART)
FIG. 2 is a schematic representation of a conventional apparatus for supplying slurry used for angle polishing.
Figure 3:
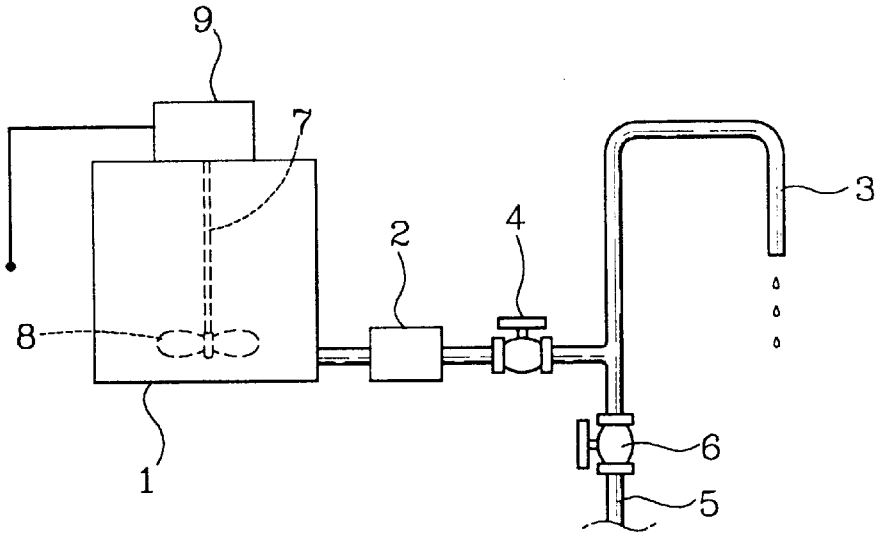
FIG. 3 is a schematic representation of an apparatus for supplying slurry according to the present invention.

The invention will now be described in greater detail with respect to the drawings. Referring to FIG. 3, the invention also relates to an apparatus for supplying the composition of the invention ("slurry composition"). The apparatus comprises a slurry composition supply tank 1, a slurry composition supply hose 3, a slurry composition supply motor 2, a paddle stirrer 8 positioned inside slurry supply tank 1 to help in reducing slurry composition solidification in the tank, and a conduit 5 for supplying deionized water through supply hose 3.

The paddle stirrer 8 is able to physically agitate the slurry and thus function to minimize solidification in the slurry composition. The paddle stirrer 8 is located at one end of rotation rod 7. Rotation rod 7 is mounted by stir motor 9 so as to be partially located within slurry supply tank 1. The rotation rod 7, the stir motor 9, and the paddle stirrer 8 are all conventional structures which are known in the art.

The supply apparatus in FIG. 3 is advantageous in that it reduces solid components within the slurry composition from precipitating and solidifying due to agitation of the slurry within tank 1.

Referring again to FIG. 3, deionized water is supplied through slurry composition supply hose 3 and conduit 5. The slurry is capable of removing the remaining solid components existing on the inner wall of the slurry composition supply hose 3 either before or after the slurry composition has passed therethrough.

A cut-off valve 4 is also present on the slurry composition supply hose 3. FIG. 3 depicts the cut-off valve 4 being present on the side of motor 2 opposite tank 1. Although not illustrated, it should be appreciated that the cut-off valve may be present on the opposite side of the motor 2 in closer proximity to tank 1. The slurry composition may be compressed by motor 2 and supplied on the surface plate of the supply apparatus via the open cut-off valve 4. Subsequent to the supplying the slurry composition, the cut-off valve 4 is typically closed to minimize or prevent any flow of deionized water therethrough. As depicted in FIG. 3, the deionized water is supplied through conduit 5 into slurry supply tank 1.

Conduit valve 6 also may be present on conduit 5 to cut off the supply of deionized water. More specifically, during the time the slurry composition is supplied through the slurry supply hose 3, the conduit valve 6 may be closed to cut off the deionized water. Conversely, when the slurry composition is not being supplied through the slurry composition supply hose 3, the conduit valve 6 may be opened such that deionized water can pass therethrough. As a result, the deionized water may remove solid materials which may be present on the inner wall of slurry composition supply hose 3. These solid materials are typically deposited from the slurry composition which passes through hose 3. Passing deionized water through hose 3 may also be able to reduce solids depositing out of the slurry composition and onto the inner wall of hose 3.

In accordance with the present invention, the wax cleaning composition is designed to remove resins such as, for example, electron wax which is used for attaching a sample taken from a wafer onto an angle stage of an angle polisher. The wax cleaning composition of the invention comprises from about 2 to about 6 weight percent of ammonium hydroxide and from about 10 to about 22 weight percent of hydrogen peroxide. Water typically makes up the remaining portion of the wax cleaning composition, preferably deionized water. More preferably, the wax cleaning composition comprises from about 3 to about 5 percent by weight of ammonium hydroxide, from about 14 to about 18 percent by weight of hydrogen peroxide, and deionized water.

The wax cleaning composition of the invention may be differentiated from a conventional cleaning solution which may be used to remove organic contaminants during the manufacture of a semiconductor device. A conventional cleaning solution typically comprises 27 parts by weight of ammonium hydroxide, 30 parts by weight of hydrogen peroxide, and 150 parts by weight of deionized water. Unlike the conventional cleaning solution which is directed to removing organic contaminants from wafer surfaces, the cleaning composition of the invention is designed to clean wax used in sample attachment.

A method of removing wax from a sample surface with the wax cleaning composition of the invention is typically carried out by contacting the sample surface with the wax cleaning composition. This operation is preferably carried out at a temperature of from about 70° C. to about 110° C. from about 1 minute to about 20 minutes. Typically, the wax cleaning composition is heated after being applied to the sample surface, although other procedures for heating the wax cleaning composition and/or sample are well within the scope of the invention.

Conventional removal of electron wax from a sample surface typically involves utilizing a mechanical cleaning operation in combination with a conventional cleaning solution, such as one containing acetone. The method of the invention, however, does not require a mechanical operation since the wax cleaning composition is used in combination with a heating step. As a result, a large number of samples may be cleaned in a shorter time period than previously realized with conventional methods. It should be noted that the cleaning efficiency using the wax cleaning solutions of the invention may decrease when temperatures less than 70° C. or greater than 110° C. are employed.

The invention will now be described in greater detail with reference to the examples which follow. It should be understood that the examples are set forth only to illustrate the invention, and are not meant as a limitation thereof.

EXAMPLE 1

Figure 4:
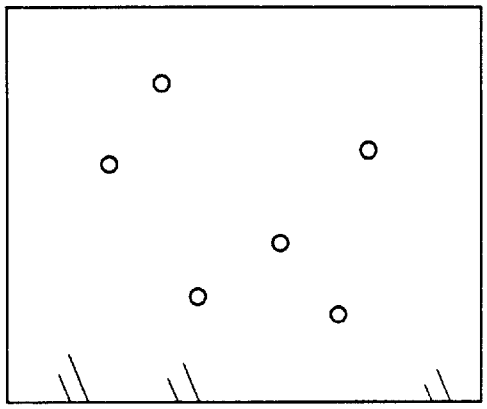
FIG. 4 (PRIOR ART)
FIG. 4 is a top view of a sample surface which has been angle polished using a conventional slurry composition.
Figure 5:
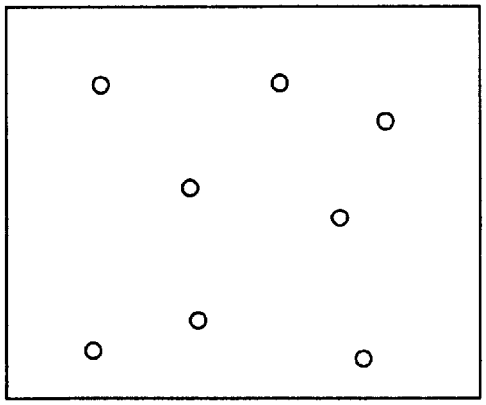
FIG. 5 is a top view of a sample surface which has been angle polished using a slurry composition of the present invention.

160 ml of an aqueous solution comprising 4 percent of sodium hydroxide and 4000 ml of deionized water is mixed with 700 ml of a slurry comprising 20 weight percent of silicon dioxide and 0.2 weight percent of aluminum oxide. A sample surface is then angle polished by employing this mixture. An angle polisher sold by Mimasu Com., of Japan is utilized. FIG. 5 shows a sample surface which is angle polished by employing the above mixture. The sample surface is detected with naked eyes via a microscope. Virtually no scratches were found on the sample surface. The result of using the wax cleaning composition in this embodiment is in great contrast to a sample surface polished by a conventional slurry solution in which a number of scratches were present on the sample surface as shown in FIG. 4.

EXAMPLE 2

Figure 7:
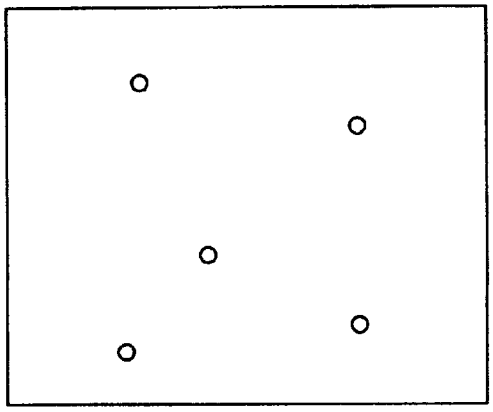
FIG. 7 is a top view of a sample surface from which electron wax has been removed using a wax cleaning composition according to the invention.

A wafer having electron wax thereon is dipped into a wax cleaning composition comprising 10 g of ammonium hydroxide, 40 g of hydrogen peroxide, and 200 g of deionized water. The wax cleaning composition is heated to a temperature of 90° C. for 10 minutes. The results of the cleaning after detecting the microscopic images are illustrated in FIG. 7. Electron wax present on a second wafer sample surface is cleaned using a conventional acetone solution. The results of the cleaning after detecting the microscopic images are illustrated in.

Figure 6:
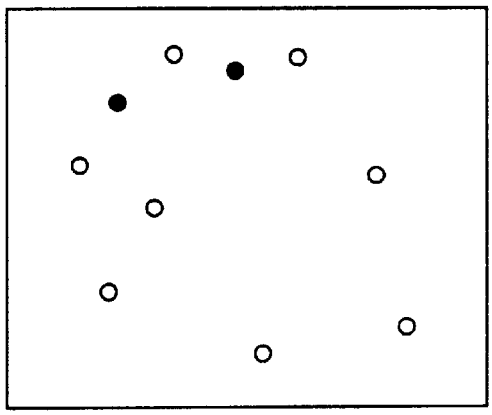
FIG. 6 (PRIOR ART)
FIG. 6 is a top view of a sample surface from which electron wax has been removed using a acetone-containing cleaning solution.

As shown in FIG. 6, some contaminants are present on the sample surface as signified by the black spots which are present. In contrast, FIG. 7 reveals no detectable evidence of contaminants remaining on the sample surface.

The present invention offers many numerous potential advantages. The slurry composition of the invention is desirable in that little scratching occurs on an angle surface by polished by the slurry composition. Solidification of the slurry is greatly reduced such that the analysis of oxygen-related deposited compounds may be quite efficient. In addition, the invention provides an apparatus for supplying slurry. The apparatus is potentially desirable in that slurry solidification within the apparatus is reduced. Thus, a constant flow of slurry may be achieved. Also, the invention provides a wax cleaning composition for removing electron wax from a sample surface by application of the wax cleaning composition under heat. The cleaning may be achieved without a mechanical cleaning step. In view of the above, the invention reduces potential for slurry composition and residual electron wax contamination which often presents difficulties in wafer processing.

In the drawings, examples, and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A composition useful for angle polishing a wafer used in a microelectronic device, said composition comprising:

a slurry comprising from about 20 to about 21 percent by weight of silicon dioxide, and from about 0.1 to about 0.2 percent by weight of aluminum oxide;

from about 100 ml to about 200 ml of an aqueous solution comprising from about 1 to about 10 weight percent of sodium hydroxide; and from about 1000 to about 7000 ml of deionized water.

2. A composition according to claim 1, wherein said composition comprises about 700 ml of said slurry.

3. A method of angle polishing a wafer to be used in a microelectronic device, said method comprising:

applying a composition to the wafer surface to angle polish the wafer, the composition comprising:

a slurry comprising from about 20 to about 21 percent by weight of silicon dioxide, and from about 0.1 to about 0.2 percent by weight of aluminum oxide;

from about 100 ml to about 200 ml of an aqueous solution comprising from about 1 to about 10 weight percent of sodium hydroxide; and from about 1000 to about 7000 ml of deionized water.

4. A method according to claim 3, wherein said composition comprises about 700 ml of said slurry.

* * * * *